United States Patent [19]

Nugues et al.

[11] Patent Number: 5,021,708

[45] Date of Patent: Jun. 4, 1991

[54] CATHODE FOR EMISSION OF ELECTRONS AND ELECTRON TUBE WITH A CATHODE OF THIS TYPE

[75] Inventors: Pierre Nugues, Auneau; Henri Desmur, Sevres; José Florentin, Paris, all of France

[73] Assignee: Thomson-Csf, Puteaux, France

[21] Appl. No.: 372,823

[22] Filed: Jun. 27, 1989

[30] Foreign Application Priority Data

Jul. 5, 1988 [FR] France ..... 88 09065

[51] Int. Cl.[5] ..... H01J 29/04; H01J 29/48

[52] U.S. Cl. ..... 313/446; 313/447; 313/346 R

[58] Field of Search ..... 313/446, 447, 454, 338, 313/346 R, 346 DC

[56] References Cited

U.S. PATENT DOCUMENTS

| | | | |
|---|---|---|---|
| 2,014,539 | 4/1933 | Stansbury | 313/338 |
| 2,581,243 | 5/1949 | Dodds | 313/338 |
| 2,883,576 | 4/1955 | Harries | 313/257 |
| 3,131,328 | 9/1955 | McNaney | 313/337 |
| 3,278,791 | 10/1966 | Favre | 315/3.5 |

FOREIGN PATENT DOCUMENTS

| | | |
|---|---|---|
| 0004424 | 10/1979 | European Pat. Off. . |
| 2390825 | 5/1977 | France . |
| 57-121125 | 7/1982 | Japan . |

*Primary Examiner*—Donald J. Yusko
*Assistant Examiner*—Brian Zimmerman
*Attorney, Agent, or Firm*—Roland Plottel

[57] ABSTRACT

This cathode has a body made of a material that does not emit electrons, having a substantially smooth non-emissive face and elements made of an emissive material each having an emissive face, spaced out from one another and fixed to the body, for example in hollows with their emissive surface in relief by a determined value with respect to said non-emissive face, so that a protection electrode can be placed between the projecting parts of these elements.

10 Claims, 1 Drawing Sheet

CATHODE FOR EMISSION OF ELECTRONS AND ELECTRON TUBE WITH A CATHODE OF THIS TYPE

BACKGROUND OF THE INVENTION

1. Field of the Invention

An object of the invention is an electron emitting cathode, with which there is associated at least one control or modulation grid, to be fitted into an electronic tube of any type, notably in the field of high frequencies. The invention also concerns any electron tube with a cathode such as this.

2. Description of the Prior Art

In electron tubes of the travelling wave tube type or, more generally, in linear beam devices, the electron beams are emitted by a cathode and are controlled by at least one electrode or, most commonly, by a set of electrodes especially designed to produce and guide this set of electrons along determined trajectories.

It is necessary, at any rate, to make electrodes with a configuration such that the equipotential lines resulting therefrom in the neighbourhood of the cathode are as parallel as possible to its surface, in both off and on modes. With cathodes having large diameters as compared with the distance from the cathode to the electron beam using device, this leads to making modulation electrodes having several apertures and, therefore, taking the form of "grids".

Typically, a modulation grid, with numerous apertures for passage, uses a modulation voltage of some hundreds of volts.

The energy needed to modulate an electrode such as this is proportionate to its capacitance with respect to the cathode and its positive voltage $V^2_{ek}$ with respect to the cathode. We can thus see the value of using low voltage electrodes, especially when the modulation frequencies are high.

However, a modulation grid that is placed in front of a surface of the cathode, emitting electrons, and that is positive with respect to this surface, receives part of the electron emission. An "interception of the beam" therefore takes place. This interception may not be troublesome when the mean density of the intercepted current is low. This is the case for medium powered or low powered devices, notably with a cathode with which a single grid is associated.

However, with high powered devices, the interception of electrons by the control grid has to be eliminated as far as possible.

It has therefore been proposed to eliminate the electron emission of the cathode in the zones facing the modulation grid, by the deposition, on the surface of the cathode, of a layer of non-emissive material. An embodiment of an approach of this type is described in the document U.S. Pat. No. 4,459,323. However, in use, it has turned out that this layer itself becomes emissive after a relatively short period, even when it is separated from the cathode by an insulating layer, following a migration of emissive material from the cathode.

SUMMARY OF THE INVENTION

The main aim of the invention is to provide a cathode, the design of which enables the use of a protection grid without contact with the cathode, hence one that is not liable to be contaminated by the emissive material of this cathode, and has a design which, at the same time, facilitates the relative arrangement of this protection grid with respect to the cathode.

It is known, besides, that in certain circumstances, the protection grid may be eliminated. In this case, it is the position of the first modulation grid that should be set precisely with respect to the cathode.

A secondary aim of the invention is to achieve a cathode with a design such that it also enables the easy installation, with respect to this cathode, of the first modulation grid when the protection grid no longer exists.

Since the protecting grid as well as the modulation grid or grids are non-emissive grids in comparision with the cathodes, the term "non-emissive grid" shall hereinafter be used to designate a protection grid, electrically connected to the potential of the cathode, as well as a modulation grid which is close to the cathode, when there is no protection grid, but is unconnected to the potential of the cathode.

A cathode according to the invention comprises a body made of a material that does not emit electrons, having a non-emissive face, and elements made of emissive material having an emissive surface, spaced out from one another in a determined, desired configuration and fixed to said body with their emissive surface in relief with respect to the non-emitting face of the body.

According to a preferred embodiment of the invention, the body made of non-emissive material has a substantially smooth, non-emissive face. Hollows, designed in this body, open out on this face and are spaced out with respect to one another according to a determined configuration. The elements made of emissive material are introduced and held fixed, respectively, in said hollows, each element being held fixed in a corresponding hollow in such a way that its emissive surface is in relief with respect to the non-emissive face of the body.

With a cathode made according to the invention, there is no particular difficulty in placing a non-emissive electrode so that it faces the network of non-emissive zones that exist on the surface of the body of the cathode, between the projecting emissive surfaces of the elements made of emissive material.

In practice, the elements made of emissive material are, advantageously, for reasons of cost, similar to chips of a shape generated by revolution that are more or less concave on their emissive face oriented towards the space of interaction. Besides, the surface of the part, with a shape generated by revolution, of these emissive chips can be advantageously treated against emission by a vapor phase deposition of a thick coat of tungsten.

With a cathode such as this, it is possible to use a non-emissive grid having substantially circular apertures, wherein the emissive faces of the chips, attached to the non-emissive body of the cathode, take position. When this first grid is a protection grid, the immediately following modulation grid is positioned with apertures, designed therein, having their geometrical axes identical with those of the axes of the first grid.

We shall now give a description of a preferred embodiment of a cathode according to the invention, and several variants which can be provided thereto.

BRIEF DESCRIPTION OF THE DRAWINGS

Reference shall be made to the appended drawings, of which.

DESCRIPTION OF PREFERRED EMBODIMENTS

Figure 1:
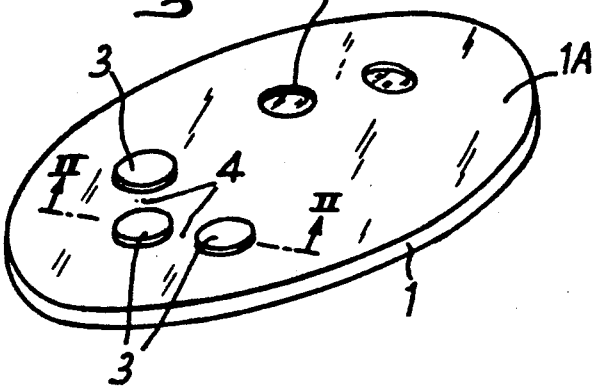
FIG. 1 is a general view in perspective of a cathode according to the invention, wherein certain hollows are shown without emissive elements and certain other hollows are each provided with an emissive element.
Figure 2:
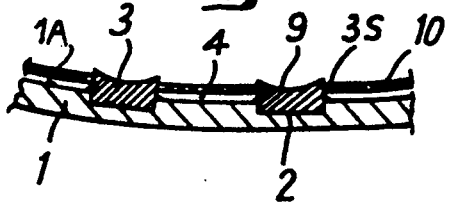
FIG. 2 shows a partial sectional view along II—II of FIG. 1.

In the example shown in FIGS. 1 and 2, the cathode has a body 1 similar to a disk of reduced thickness, made of a non-emissive material, for example boron nitride or aluminium nitride, or silicon carbide or tungsten carbide or pure tungsten or molybdenum, having a main face 1A which is smooth or at least a substantially smooth. Starting from this face 1A, hollows 2 are made by machining or by other means. These hollows 2 are actually blind holes that do not go through the body 1. These hollows 2 are spaced out from one another and distributed according to a determined configuration suitable for the use that is envisaged for the cathode, for example in an electron gun.

Each hollow 2 contains an emissive chip 3. The latter is, for example, made of porous tungsten impregnated with an emissive mixture such as a barium/calcium aluminate. It is fixed to the body 1 by a brazing done with a molybdenum/ruthenium alloy. Each chip 2 has a thickness greater than the depth of the hollow 2 which contains it partially so that this chip projects, as is clearly seen in FIG. 2, from the main face 1A of the body 1. Between the projecting parts 3S of the emissive chips 3 neighboring one another, there is an interval 4. The intervals 4 communicate with one another in forming a network.

In the example of FIG. 1, the emissive chips 3 are held still in the corresponding hollows 2 by a brazing operation, known per se.

Figure 3:
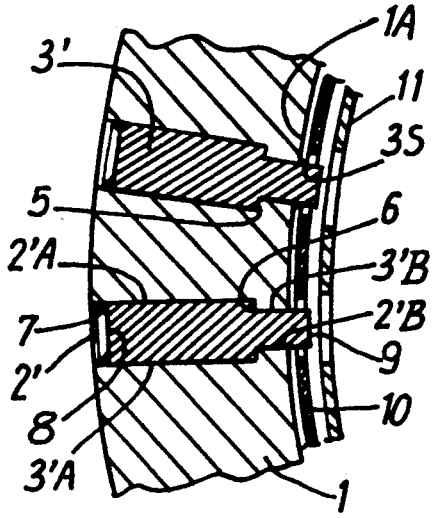
FIGS. 3 to 6 are partial sectional views analogous to FIG. 2, showing alternative embodiments according to the invention.
Figure 4:
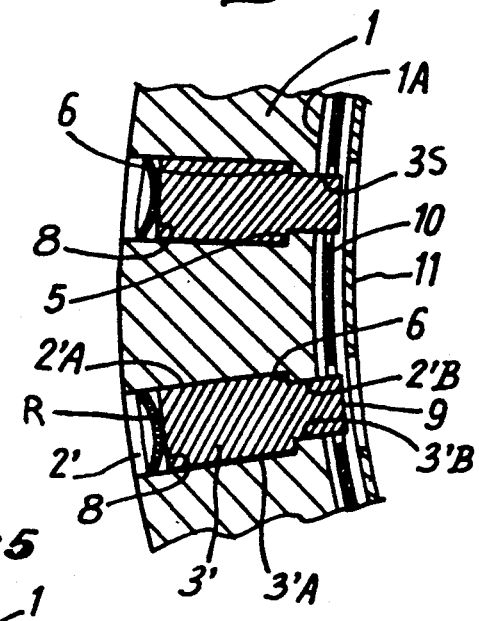
Figure 5:
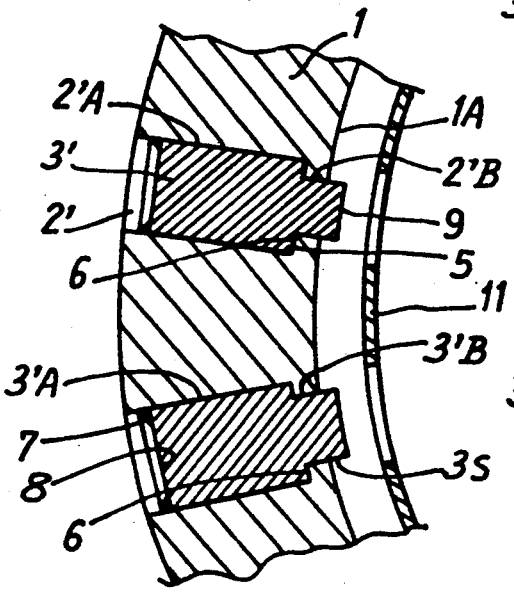

FIGS. 3 to 5 pertain to variants wherein the body 1 of the cathode is thicker and each hollow 2' is a hole that goes through the entire thickness of the body 1. Each hole 2 has two successive parts, a part 2'A with a greater diameter and a part 2'B with a smaller diameter: this leads to the appearance between the two, in the thickness of the body 1, of an internal shoulder 5. Since the part 2'B with a smaller diameter is the one that opens out on the face 1A of the body 1, each shoulder 2 is pointed in the direction opposite to this face.

Each emissive element 3' also has two parts 3'A, 3'B with different diameters, corresponding to the diameters of the parts 3A, 3B of the holes 3, with, consequently, an external shoulder 6 that is applied against the internal shoulder 5 after the insertion of the elements 3' in the hollows 2'. This alternative embodiment in no way changes the existence of the above-described projecting part 3S.

On each emissive element 3', the length of its part 3'B that has a smaller diameter, that is, the length starting from its external shoulder 6, is greater than the distance between the internal shoulder 5 and the face 1A so that this part 3'B projects from this face 1A.

In the alternatives shown in FIGS. 3 and 5, the emissive elements 3 are held fixed in the hollows 2' which contain them by means of a brazing bead 7. Preferably, the part 3'A with a greater diameter has a length from the external shoulder 6 such that the end face 8 of this part, opposite the projecting emissive face 9, is recessed inside the corresponding part 2'A of the hollow 2', thus enabling the brazing bead 7 to be made inside it and on the end face 8.

In the alternative embodiment of FIG. 4, the emissive elements 3' are held fixed in the hollows 2 by springs R shaped, for example, as spherical caps with a diameter chosen so that they can be inserted, by being thrust, into the part 2A with a greater diameter, up to face 8, and so that they produce a buttressing effect in reverse direction.

FIG. 2 also shows that the emissive face 9 of the emissive elements 3 may have a concave profile.

FIGS. 2 to 5 also show how a non-emissive grid can be associated with the cathode of the invention. Preferably, a grid such as this has apertures with a configuration similar to that of the hollows 2, 2'. When the latter are holes, the apertures of the grid are made with a diameter slightly greater than that of the emissive face 9 of each emissive element 3 (FIG. 2), for example equal to the diameter of the part 2'A, having the greater diameter, of the hollow 3' (FIGS. 3 to 5).

When the grid is a protection grid, drawn in a small thickness and designated by the reference number 10 in FIGS. 2 to 4, it is placed in the interval 4 between the projecting parts 3S. There is thus a relationship, that is easy to determine, between the size of the projecting parts 3S and the thickness of the protection grid. At the minimum, the size of the projecting parts 3S is equal to the thickness of this grid. The latter is electrically connected, in a known way (not shown), to the body 1 of the cathode.

FIGS. 3 and 4 also show a modulation grid 11 mounted in the "shadow" of the protection grid.

FIG. 5 pertains to the case where there is no protection grid. The modulation grid 11 is mounted beyond the zone of the projecting parts 3S.

Figure 6:
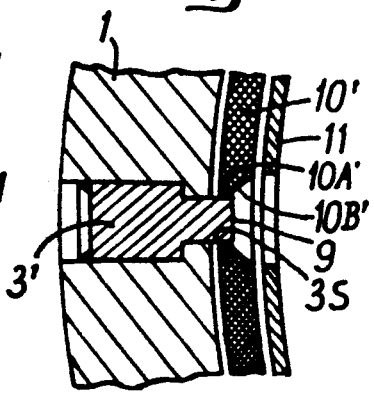

FIG. 6 pertains to an alternative embodiment which shows that the arrangement of the protection grid 10' may have a thickness greater than the size of the projecting parts 3S of the emissive elements. However, in this case, each aperture of the protection grid 10' that corresponds to an emissive element 3', is flared out and widens, at 10B', starting from the plane in which the projecting emissive face 9 of this emissive element 3' is substantially located. Before this flared-out zone 10B', starting from the face of the protection grid 10' facing the body 1, the aperture has a cylindrical zone 10A'. In this case, it is in considering the length, in an axial direction, of this cylindrical zone 10A' that the relationship with the size of each projecting part 3S is determined. In this variant, the apertures of the modulation grid 11 are made in relation with the greatest dimension of the flared-out zones 10B'.

The means for holding the non-emissive grids in position are known and standard ones, and have not been shown. Of course, the emissive elements 3, 3' are connected to each other electrically, for example by their rear end faces 8, to equalize their potential.

As a rule, the body 1 of the cathode is made of a non-emissive but electrically conductive material. The invention does not exclude the use of a body made of a non-conductive material. In this case, the emissive elements 3, 3' are electrically connected, also by their rear faces 8 for example.

In an electron gun, or in another apparatus in which it is used, the cathode of the invention is associated, as is known, with a device for heating the emissive elements 3, 3' to the requisite temperature.

What is claimed is:

1. An electron gun comprising one or more grids and a cathode, wherein said cathode has a body made of a metallic or dielectric material which does not emit electrons, having a non-emissive face, elements made of emissive material attached mechanically to said body, each emissive element having an emissive surface, said emissive elements being spaced out from one another according to a determined, desired configuration in such a way that all the beams emitted are particularly suited to a linear beam tube, and wherein said emissive elements are fixed to said body with their emissive surface in relief by a determined value with respect to said non-emissive face of the body, so that said value is sufficient to enable said emissive elements to go beyond a metallic grid placed in the vicinity of but not in mechanical contact with the surface of said body.

2. An electron gun according to claim 1, wherein said body has hollows opening out in the rear face of the cathode, spaced out from one another according to said desired configuration, and said emissive elements are introduced and held fixed, respectively, in said hollows, each element being held fixed in a corresponding hollow in such a way that its emissive surface is in front of a hole of said grid to penetrate said grid through said holes.

3. An electron gun according to claim 2, wherein the hollows are blind holes.

4. An electron gun according to claim 2, wherein the hollows are holes going through the body and comprise a part with a bigger transversal dimension and a part with a smaller transversal dimension, opening out on the non-emissive face, these two parts causing the appearance of an internal shoulder while the emissive parts also have two parts with different transversal dimensions causing the appearance of an external shoulder, these two shoulders being applied against each other.

5. An electron gun according to claim 4, wherein each emissive element is terminated opposite its emissive surface by an end face which is recessed within the part corresponding to the hollow.

6. An electron gun according to claim 5, wherein each emissive element is held still in the corresponding hollow by a soldering seam inside said part and on the recessed end face.

7. An electron gun according to claim 5, wherein each emissive element is held still in the corresponding hollow by a spring in the form of a spherical cap supported inside said part against the recessed end face.

8. An electron gun according to any of the claims 1 to 7, wherein said body is made of tungsten.

9. An electron gun according to any of the claims 1 to 5 and 7, wherein said body is made of a material chosen between an aluminum nitride, a silicon nitride, a silicon carbide and a tungsten carbide.

10. An electron gun according to claim 1 wherein said gun further comprises an electron tube and said electron gun is mounted in said electron tube.

* * * * *